US005571665A

United States Patent [19]

Ballerini et al.

[11] Patent Number: 5,571,665

[45] Date of Patent: Nov. 5, 1996

[54] SILVER HALIDE PHOTOGRAPHIC MATERIAL HAVING IMPROVED ANTISTATIC PROPERTIES

[75] Inventors: Dario Ballerini; Marco Bucci, both of Genova; Domenico Marinelli, Ferrania; Renzo Torterolo, Bragno, all of Italy

[73] Assignee: Imation Corp., Woodbury, Minn.

[21] Appl. No.: 286,277

[22] Filed: Aug. 5, 1994

[30] Foreign Application Priority Data

Oct. 6, 1993 [EP] European Pat. Off. ..... 93116137

[51] Int. Cl.[6] ..... G03C 1/85

[52] U.S. Cl. ..... 430/527; 430/523; 430/637

[58] Field of Search ..... 430/527, 523, 430/961, 637

[56] References Cited

U.S. PATENT DOCUMENTS

| | | | |
|---|---|---|---|
| 3,850,640 | 11/1974 | Babbit et al. | 430/528 |
| 4,367,283 | 1/1983 | Nakayama et al. | 430/528 |
| 4,582,781 | 4/1986 | Chen et al. | 430/527 |
| 4,596,766 | 6/1986 | Nemori et al. | 430/527 |
| 4,610,955 | 9/1986 | Chen et al. | 430/527 |
| 4,649,102 | 3/1987 | Mukunoki et al. | 430/527 |
| 4,847,186 | 7/1989 | Mukunoki et al. | 430/523 |
| 4,891,307 | 1/1990 | Mukunoki et al. | 430/527 |
| 5,037,871 | 8/1991 | Jones | 430/523 |
| 5,137,802 | 8/1992 | Ueda et al. | 430/523 |

FOREIGN PATENT DOCUMENTS

| | | |
|---|---|---|
| 0245090 | 5/1987 | European Pat. Off. . |
| 0319951 | 9/1991 | European Pat. Off. . |
| 0534006 | 3/1993 | European Pat. Off. . |
| 1525140 | 9/1978 | United Kingdom . |
| 2246870 | 12/1992 | United Kingdom . |
| WO91/18325 | 11/1991 | WIPO . |

*Primary Examiner*—Janet C. Baxter
*Assistant Examiner*—Christopher G. Young
*Attorney, Agent, or Firm*—Mark Litman; Gregory A. Evearitt

[57] ABSTRACT

The present invention relates to a silver halide photographic material comprising a support, at least one silver halide emulsion layer coated thereon, and a hydrophilic colloid layer coated on said at least one silver halide emulsion layer, wherein said hydrophilic colloid layer comprises a combination of (a) at least one surfactant selected from the group consisting of non-ionic polyoxyethylene surfactants and anionic polyoxyethylene surfactants and (b) at least one surfactant selected from the group consisting of non-ionic perfluoroalkylpolyoxyethylene surfactants and polyoxyethylene-modified polysiloxane surfactants.

7 Claims, No Drawings

SILVER HALIDE PHOTOGRAPHIC MATERIAL HAVING IMPROVED ANTISTATIC PROPERTIES

FIELD OF THE INVENTION

The present invention relates to a silver halide photographic material, more particularly to a silver halide photographic material having improved antistatic property and improved coating ability.

BACKGROUND OF THE INVENTION

Silver halide photographic materials are generally composed of an electrically insulating support and photographic layers coated thereon. Such a structure promotes the formation and accumulation of static charges when subjecting the photographic materials to friction or separation, caused by contact with the surface of the same or different materials during steps for manufacturing of the photographic materials or when using them for photographic purposes. These accumulated static charges cause several drawbacks. The most serious drawback is discharge of accumulated charges prior to development processing, by which the light-sensitive silver halide emulsion layer is exposed to light to form dot spots or branched or feathery linear specks when development of the photographic film is carried out. This is the phenomenon of the so-called "static marks". Such static marks cause a reduction of the commercial value of photographic films, which sometimes become completely useless. For example, the formation of static marks in medical or industrial X-ray films may result in a very dangerous judgment or erroneous diagnosis. Static marks are a particular problem because it becomes evident for the first time by carrying out development. Further, these static charges are also the origin of secondary problems such as adhesion of dusts to the surface of films, uneven coating, and the like.

As mentioned above, such static charge are frequently accumulated when manufacturing and/or using silver halide photographic materials. For example, during production, they are generated by friction of the photographic film contacting a roller or by separation of the emulsion surface from the support surface during a rolling or unrolling step. Further, they are generated on X-ray films in an automatic apparatus by contact with or separating from mechanical parts or fluorescent screens, or they are generated by contact with or separation from rollers and bars made of rubber, metal, or plastics in a bonding machine or an automatic developing machine or an automatic developing apparatus or in a camera in the case of using color negative films or color reversal films. In addition they can be generated by contacting with packing materials, and the like.

Silver halide photographic materials having high sensitivity and handling speed are subject to an increase of static mark appearance. In particular, static marks are easily generated because of high sensitization of the photographic material and severe handling conditions such as high speed coating, high speed exposure, and high speed automatic processing.

In order to prevent problems caused by static charges, it is suitable to add an antistatic agent to the silver halide photographic materials. However, antistatic agents conventionally used in other fields cannot be used universally for silver halide photographic materials, because they are subjected to various restrictions due to the nature of the photographic materials. More specifically, the antistatic agents which can be used in silver halide photographic materials must have excellent antistatic abilities while not having adverse influences upon photographic properties of the photographic materials, such as sensitivity, fog, granularity, and sharpness. Such antistatic agents also must not have adverse influences upon the film strength and upon antiadhesion properties. Furthermore, the antistatic agents must not accelerate exhaustion of processing solutions and not deteriorate adhesive strength between layers composing the silver halide photographic material.

In the art of silver halide photographic materials, a wide number of solutions to the above described problems have been suggested in patent and literature references, mainly based on charge control agents and electrically conductive compounds coated on the silver halide emulsion layer together with a binder as an antistatic layer.

The most useful charge control agents known in the art are ionic and non-ionic surfactants as well as ionic salts. Fluorinated surfactants are often mentioned as good antistatic agents in silver halide photographic materials.

Electrically conductive compounds are mainly focused on conductive polymers such as ionic polymers and electronically conductive polymers.

The use of ionic and non-ionic surfactants as well as fluorinated surfactants is widely disclosed in many patents, such as, for example, U.S. Pat. Nos. 2,600,831, 2,719,087, 2,982,651, 3,026,202, 3,428,456, 3,457,076, 3,454,625, 3,552,972, 3,655,387, 3,850,640, 3,850,642, 4,192,683, 4,267,265, 4,304,852, 4,330,618, 4,367,283, 4,474,873, 4,510,233, 4,518,354, 4,596,766, 4,649,102, 4,703,000, 4,847,186, 4,891,307, 4,891,308, 4,916,054, EP 245,090, 300,259, 319,951, 370,404, and the like.

The use of conductive polymers is widely disclosed in many other patents, such as, for example, U.S. Pat. Nos. 2,882,157, 2,972,535, 3,062,785, 3,262,807, 3,514,291, 3,615,531, 3,753,716, 3,769,020, 3,791,831, 3,861,924, 3,938,999, 4,147,550, 4,225,665, 4,363,872, 4,388,402, 4,460,679, 4,582,783, 4,585,730, 4,590,151, 4,701,403, 4,960,687, EP 35,614, 36,702, 87,688, 391,176, 391,402, 424,010, GB 815,662, 1,222,595, 1,539,866, 2,001,078, 2,109,705.

In particular U.S. Pat. No. 4,649,102 discloses the combination of a non-ionic surfactant and an anionic surfactant having a polyoxyethylene group therein, U.S. Pat. No. 4,847,186 discloses the use of a fluorinated ionic or non-ionic compound, EP 245,090 discloses the combination of fluoroalkylpolyoxyethylene compounds with fluorine-containing polymers and a polyoxyethylene non-ionic surfactant together with a high-molecular high weight hardening agent, U.S. Pat. No. 3,850,640 discloses the combination of a first layer comprising an anionic surfactant and a second layer comprising cationic and non-ionic surfactants, U.S. Pat. No. 4,596,766 discloses the combination of a polyoxyethylene non-ionic surfactant and a fluorine-containing compound, U.S. Pat. No. 4,367,283 discloses the combination of a polyoxyethylene non-ionic surfactant, a sulfonated surfactant, and a fluorine-containing phosphate surfactant, GB 2,246,870 discloses the combination of a polyoxyalkylene compound and a polystyrenesulfonate compound, U.S. Pat. No. 5,037,871 and WO 91/18325 disclose the use of hydrolyzed metal lower alkoxide in combination with fluoroalkyl polyether surfactants and a water-soluble hydroxylated polymer, U.S. Pat. No. 4,891,308 discloses the use of ionic and non-ionic fluorine containing surfactant together with a fluorine free non-ionic surfactant, EP 319,951 describes the combination of an anionic and non-ionic surfactant with a fluorinated non-ionic surfactant, U.S. Pat. Nos. 4,610,955 and 4,582,781 describe the combination of an inorganic salt with polymers containing blocks of polymerized oxyalkylene monomers.

However, many of these substances and combinations thereof exhibit great specificity, depending upon the kind of film support or the photographic composition. Although some substances produce good results on certain specific film supports, photographic emulsions or other photographic elements, they are not only useless for preventing generation of static marks when using different film supports and photographic elements, but also may have an adverse influence upon photographic properties.

On the other hand, there are many cases wherein, although they have excellent antistatic effects, they cannot be used due to their adverse influence upon photographic properties such as sensitivity, fog, granularity, sharpness, and the like.

For example, it has been well known that polyethylene oxide compounds have antistatic effects, but they often have an adverse influence upon photographic properties, such as an increase in fog, desensitization, and deterioration of granularity, in particular in silver halide photographic materials in which both sides of the support are coated with silver halide emulsions, such as medical X-ray photographic materials. The combination of polyoxyethylene compounds with organic salts can improve the surface resistivity, but also may increase of tackiness and film-to-film adhesion.

The use of fluorinated surfactants for controlling the electricity generation caused by friction or contacting with different materials, such as, for example, rollers, increases the charging in negative polarity. Accordingly, although it is possible to adapt the electric characteristics of the silver halide photographic material for each roller, such as, for example, rubber rollers, Delrin™ rollers, and nylon rollers by suitably combining the fluorinated surfactants with surfactants, charging in positive polarity problems still occurs, because a general solution for all kind of rollers cannot be obtained.

Moreover, the market requirement of silver halide photographic material having a reduced processing time has increased the problems of static charges due to the higher speed to which silver halide photographic materials go through the automatic processors.

Furthermore, the increasing demand of the radiographic market of medical X-ray silver halide photographic material, due to the increase in the worldwide consumption and diffusion of apparatus for X-ray diagnosis, requires an increase in productivity of medical X-ray photographic material that can be obtained with an increase of coating speed. Higher coating speed increases the appearance of static charges, if conventional antistatic agents are used.

SUMMARY OF THE INVENTION

The present invention relates to a silver halide photographic material comprising a support, at least one silver halide emulsion layer coated thereon, and a hydrophilic colloid layer coated on said at least one silver halide emulsion layer, wherein said hydrophilic colloid layer comprises a combination of (a) at least one surfactant selected from the group consisting of non-ionic polyoxyethylene surfactants and anionic polyoxyethylene surfactants and (b) at least one surfactant selected from the group consisting of non-ionic perfluoroalkylpolyoxyethylene surfactants and polyoxyethylene-modified polysiloxane surfactants.

DETAILED DESCRIPTION OF THE INVENTION

The silver halide photographic material according to the present invention can comprise a combination of a non-ionic polyoxyethylene surfactant and/or an anionic polyoxyethylene surfactant, and a non-ionic perfluoroalkylpolyoxyethylene surfactant and/or a polyoxyethylene-modified polysiloxane surfactant. The combination is coated on the silver halide emulsion layer together with a hydrophilic binder as a top-coat protective layer. According to a preferred embodiment of the invention, the combination comprises an anionic polyoxyethylene surfactant, and at least two other surfactants selected from the group of non-ionic polyoxyethylene surfactant, non-ionic perfluoroalkylpolyoxyethylene surfactant and a polyoxyethylene-modified polysiloxane surfactant.

The non-ionic polyoxyethylene surfactants useful in the combination of the present invention can be represented by the following formula:

$$R_2-(D)q-(\underset{\underset{R_3}{|}}{CH}-CH_2-O)r-H$$

wherein $R_2$ represents an alkyl group having 1 to 30 carbon atoms, an alkenyl group having 1 to 30 carbon atoms or an aryl group having 6 to 30 ring atoms (such as phenyl or naphthyl) or a combination thereof, $R_3$ represents a hydrogen atom or a methyl group, D represents a group —O—, —S—, —COO—, —$NR_4$—, —CO—$NR_4$—, or —$SO_2$—$NR_4$—, wherein $R_4$ represents a hydrogen atom or an alkyl group having 1 to 12 carbon atoms, q represents 0 or 1 and r represents an integer of 2 to 50.

According to the scope of the present invention when the term "group" is used to describe a chemical compound or substituent, the described chemical material includes the basic group and that group with conventional substitution. Where the term "moiety" is used to describe a chemical compound or substituent only an unsubstituted chemical material is intended to be included.

Examples of non-ionic polyoxyalkylene surfactants are illustrated below.

$$C_{12}H_{25}-O-(CH_2-CH_2-O)_{10}-H \quad \text{(A-1)}$$

$$C_8H_{17}-O-(CH_2-CH_2-O)_7-H \quad \text{(A-2)}$$

$$C_{11}H_{23}-\overset{\overset{O}{||}}{C}-O-(CH_2-CH_2-O)_8-H \quad \text{(A-3)}$$

$$C_{15}H_{31}-\overset{\overset{O}{||}}{C}-O-(CH_2-CH_2-O)_{15}-H \quad \text{(A-4)}$$

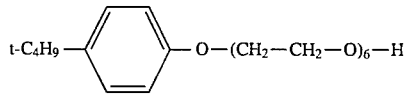

(A-5)

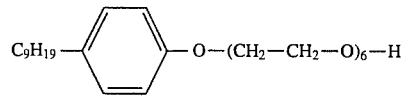

(A-6)

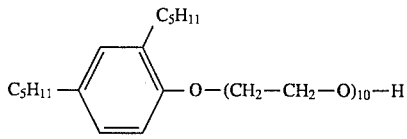

(A-7)

-continued $$C_8H_{17}-SO_2-\underset{\underset{C_3H_7}{|}}{N}-(CH_2-CH_2-O)_{20}-H \quad \text{(A-8)}$$

$$C_{13}H_{27}-CO-\underset{\underset{CH_3}{|}}{N}-(CH_2-CH_2-O)_{10}-H \quad \text{(A-9)}$$

$$C_{18}H_{37}-N\begin{cases}(CH_2-CH_2-O)a-H\\(CH_2-CH_2-O)a-H\end{cases} \quad a+b=20 \quad \text{(A-10)}$$

$$C_{12}H_{25}-O-(\underset{\underset{CH_3}{|}}{CH}-CH_2-O)_3-(CH_2-CH_2-O)_{15}-H \quad \text{(A-11)}$$

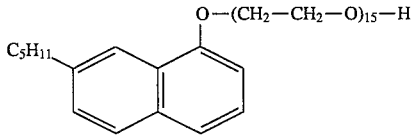

(A-12)

The non-ionic polyoxyalkylene surfactants are employed in an amount of from 10 to 200 mg/m$^2$, preferably from 50 to 100 mg/m$^2$ of top-coat protective layer.

Anionic polyoxyethylene surfactants, normally used in photography, are surfactants of the type including a polyoxyethylene group linked to an anionic hydrophilic group and to a hydrocarbon residue directly or by means of a bridge consisting of a divalent organic residue, as expressed by the following formula:

$$R-(A)_m-(CH_2-CH_2-O)_n-X$$

wherein

R is an aliphatic, aromatic or a mixed hydrocarbon residue and preferably a linear or branched alkyl group having from 4 to 18 carbon atoms or an aryl group substituted with one or more alkyl groups altogether having from 4 to 18 carbon atoms, A is a divalent organic residue, preferably a carbonyl, a sulfonyl, an amino or an alkylene group preferably having from 1 to 3 carbon atoms, an oxygen atom or groups consisting of two or more of the above-mentioned groups; such as for example carbonylamino, sulfonylamino, aminocarbonyl, aminosulfonyl, or ester, X is an anionic group selected from the class consisting of sulfonate group, carboxylate group, phosphate group and sulfate group, and m is 0 or 1 and n is an integer of from 1 to 25.

Anionic surface active agents of this type are described for example in Schwarz et al. "Surface Active Agents and Detergents", Vol. I and II, Interscience Publ., in the U.S. Pat. Nos. 2,992,108, 3,068,101, 3,201,152 and 3,165,409, in the French Pat. Nos. 1,556,240 and 1,497,930 and in the British Pat. Nos. 580,504 and 985,483.

Examples of anionic polyoxyethylene surfactants useful in the combination of the present invention are listed hereinbelow.

$$C_{17}H_{33}-\underset{\underset{O}{||}}{C}-\underset{\underset{CH_3}{|}}{N}-(CH_2CH_2O)_4-SO_3Na \quad \text{(B-1)}$$

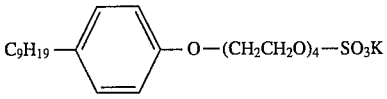

(B-2)

-continued $$C_{12}H_{25}-O-(CH_2CH_2O)_2-SO_3Na \quad \text{(B-3)}$$

$$C_{18}H_{35}-NH-SO_2-(CH_2CH_2O)_4-SO_3Na \quad \text{(B-4)}$$

$$C_{12}H_{25}-NH-\underset{\underset{O}{||}}{C}-(CH_2CH_2O)_8-SO_3Na \quad \text{(B-5)}$$

$$C_{12}H_{25}-\underset{\underset{O}{||}}{C}-O-(CH_2CH_2O)_8-SO_3Na \quad \text{(B-6)}$$

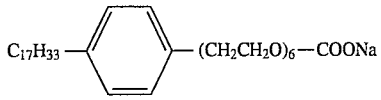

(B-7)

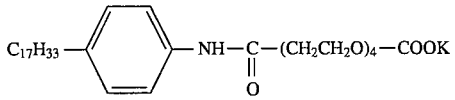

(B-8)

The anionic polyoxyalkylene surfactants are employed in an amount of from 10 to 200 mg/m$^2$, preferably from 50 to 100 mg/m$^2$ of top-coat protective layer.

The term "non-ionic perfluoroalkylpolyoxyethylene surfactants" means a non-ionic surfactant comprising a mixture of compounds consisting in an aliphatic group of from 6 to 16 carbon atoms wherein the hydrogens are totally replaced by fluorine atoms jointed to a polyoxyethylene group comprising from 6 to 15 oxyethylene groups. The non-ionic perfluoroalkylpolyoxyethylene surfactants can be represented by the following formula:

$$F-(CF_2CF_2)_x-CH_2-\overset{\overset{R}{|}}{CH}-O-(CH_2\overset{\overset{R'}{|}}{C}HO)_y-H$$

wherein R and R' are, independently, hydrogen or a lower alkyl of from 1 to 4 carbon atoms, x is an integer from 3 to 8, and y is an integer from 6 to 15.

A particularly preferred non-ionic perfluoroalkylpolyoxyethylene surfactant is the Zonyl™ FSN, a trade name of DuPont Company. Non-ionic perfluoroalkylpolyoxyethylene surfactants are used in amount of from 10 to 100 mg/m$^2$, preferably from 20 to 60 mg/m$^2$, more preferably of about 40 mg/m$^2$.

According to a preferred embodiment of the present invention, the surfactant combination can further comprise a polyoxyethylene-modified polysiloxane surfactant. The polyoxyethylene-modified polysiloxane surfactant comprises a non-ionic polysiloxane polymer (preferably having a linear polymeric backbone) which has pendant polyoxyethylene polymeric units adhered to the polysiloxane backbone. The polyoxyethylene chain is preferably linked to the polysiloxane through ether linkages, and the polyoxyethylene may also contain propylene units as random or block units throughout the polyoxyethylene chain. The polyoxyethylene-modified polysiloxane surfactant can be better represented by the following formula:

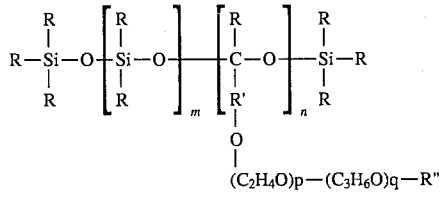

wherein R is a lower alkyl having from 1 to 4 carbon atoms, R' is a lower alkylene having from 1 to 4 carbon atoms, R"

is hydrogen or a lower alkyl of from 1 to 4 carbon atoms, m is an integer from 5 to 100, n is an integer from 2 to 50, p is an integer from 5 to 50, and q is an integer from 0 to 50. Compound of this class are sold by Union Carbide Co., under the trade name of Silwet™. Examples of useful compounds for use in the combination of the present invention are Silvwet™ L-7605, Silwet™ L-77, Silwet™ L-7001, and the like.

Photographic materials according to the invention generally comprise at least one light sensitive layer, such as a silver halide emulsion layer, coated on at least one side of a support.

Silver halide emulsions typically comprise silver halide grains which may have different crystal forms and sizes, such as, for example, cubic grains, octahedral grains, tabular grains, spherical grains and the like. Tabular grains are preferred. The tabular silver halide grains contained in the silver halide emulsion layers of this invention have an average diameter:thickness ratio (often referred to in the art as aspect ratio) of at least 3:1, preferably 3:1 to 20:1, more preferably 3:1 to 14:1, and most preferably 3:1 to 8:1. Average diameters of the tabular silver halide grains suitable for use in this invention range from about 0.3 to about 5 μm, preferably 0.5 to 3 μm, more preferably 0.8 to 1.5 μm. The tabular silver halide grains suitable for use in this invention have a thickness of less than 0.4 μm, preferably less than 0.3 μm and more preferably less than 0.2 μm.

The tabular silver halide grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains of the invention, at least 15%, preferably at least 25%, and, more preferably, at least 50% of the silver halide grains are tabular grains having an average diameter:thickness ratio of not less than 3:1. Each of the above proportions, "15%", "25%" and "50%" means the proportion of the total projected area of the tabular grains having a diameter:thickness ratio of at least 3:1 and a thickness lower than 0.4 μm, as compared to the projected area of all of the silver halide grains in the layer. Other conventional silver halide grain structures such as cubic, orthorhombic, tetrahedral, etc. may make up the remainder of the grains.

In the present invention, commonly employed halogen compositions of the silver halide grains can be used. Typical silver halides include silver chloride, silver bromide, silver iodide, silver chloroiodide, silver bromoiodide, silver chlorobromoiodide and the like. However, silver bromide and silver bromoiodide are preferred silver halide compositions for tabular silver halide grains with silver bromoiodide compositions containing from 0 to 10 mol % silver iodide, preferably from 0.2 to 5 mol % silver iodide, and more preferably from 0.5 to 1.5% mol silver iodide. The halogen composition of individual grains may be homogeneous or heterogeneous.

Silver halide emulsions containing tabular silver halide grains can be prepared by various processes known for the preparation of photographic materials. Silver halide emulsions can be prepared by the acid process, neutral process or ammonia process. In the stage for the preparation, a soluble silver salt and a halogen salt can be reacted in accordance with the single jet process, double jet process, reverse mixing process or a combination process by adjusting the conditions in the grain formation, such as pH, pAg, temperature, form and scale of the reaction vessel, and the reaction method. A silver halide solvent, such as ammonia, thioethers, thioureas, etc., may be used, if desired, for controlling grain size, form of the grains, particle size distribution of the grains, and the grain-growth rate.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No. 2 (1962), pp. 121–125, in Gutoff, "Nucleation and Growth Rates During the Precipitation of Silver Halide Photographic Emulsions", Photographic Science and Engineering, Vol. 14, No. 4 (1970), pp. 248–257, in Berry et al., "Effects of Environment on the Growth of Silver Bromide Microcrystals", Vol. 5, No. 6 (1961), pp. 332–336, in U.S. Pat. Nos. 4,063,951, 4,067,739, 4,184,878, 4,434,226, 4,414,310, 4,386,156, 4,414,306 and in EP Pat. Appl. No. 263,508.

As a binder for silver halide emulsions and other hydrophilic colloid layers, gelatin is preferred, but other hydrophilic colloids can be used, alone or in combination, such as, for example, dextran, cellulose derivatives (e.g., hydroxyethylcellulose, carboxymethyl cellulose), collagen derivatives, colloidal albumin or casein, polysaccharides, synthetic hydrophilic polymers (e.g., polyvinylpyrrolidone, polyacrylamide, polyvinylalcohol, polyvinylpyrazole) and the like. Gelatin derivatives, such as, for example, highly deionized gelatin, acetylated gelatin and phthalated gelatin can also be used. Highly deionized gelatin is characterized by a higher deionization with respect to the commonly used photographic gelatins. Preferably, highly deionized gelatin is almost completely deionized which is defined as meaning that it presents less than 50 ppm (pads per million) of $Ca^{++}$ ions and is practically free (less than 5 pads per million) of other ions such as chlorides, phosphates, sulfates and nitrates, compared with commonly used photographic gelatins having up to 5,000 ppm of Ca++ ions and the significant presence of other ions.

The highly deionized gelatin can be employed not only in the silver halide emulsion layers containing tabular silver halide grains, but also in other component layers of the photographic element, such as silver halide emulsion layers containing other than tabular silver halide grains, overcoat layers, interlayers and layers positioned beneath the emulsion layers. In the present invention, preferably at least 50%, more preferably at least 70% of the total hydrophilic colloid of the photographic element comprises highly deionized gelatin. The amount of gelatin employed in the light-sensitive photographic material of the present invention is such as to provide a total silver to gelatin ratio lower than 1 (expressed as grams of Ag/grams of gelatin). In particular the silver to gelatin ratio of the silver halide emulsion layers is in the range of from 1 to 1.5.

Silver halide emulsion layers can be sensitized to a particular range of wavelengths with a sensitizing dye. Typical sensitizing dyes include cyanine, hemicyanine, merocyanine, oxonols, hemioxonols, styryls, merostyryls and streptocyanines. The silver halide photographic material of the present invention can have one or more silver halide emulsion layers sensitized to the same or different regions of the electromagnetic spectrum. The silver halide emulsion layers can be coated on one side or on both side of a support base.

Examples of materials suitable for the preparation of the support include glass, paper, polyethylene-coated paper, metals, polymeric film such as cellulose nitrate, cellulose acetate, polystyrene, polyethylene terephthalate, polyethylene, polypropylene and the like.

Specific photographic materials according to the invention are black-and-white light-sensitive photographic materials, in particular X-ray light-sensitive materials.

Preferred light-sensitive silver halide photographic materials according to this invention are radiographic light-sensitive materials employed in X-ray imaging comprising a silver halide emulsion layer(s) coated on one surface, preferably on both surfaces of a support, preferably a polyethylene terephthalate support. Preferably, the silver halide emulsions are coated on the support at a total silver coverage in the range of 3 to 6 grams per square meter. Usually, the radiographic light-sensitive materials are associated with intensifying screens so as to be exposed to radiation emitted by said screens. The screens are made of relatively thick phosphor layers which transform the X-rays into more imaging-effective radiation such as light (e.g., visible light). The screens absorb a much larger portion of X-rays than the light-sensitive materials do and are used to reduce the X-ray dose necessary to obtain a useful image. According to their chemical composition, the phosphors can emit radiation in the ultraviolet, blue, green or red region of the visible spectrum and the silver halide emulsions are sensitized to the wavelength region of the radiation emitted by the screens. Sensitization is performed by using spectral sensitizing dyes absorbed on the surface of the silver halide grains as known in the art.

More preferred light-sensitive silver halide photographic materials according to this invention are radiographic light-sensitive materials which employ intermediate diameter-:thickness ratio tabular grain silver halide emulsions, as disclosed in U.S. Pat. No. 4,425,426 and in EP Pat. Appl. 84,637.

However other black-and-white photographic materials, such as lithographic light-sensitive materials, black-and-white photographic printing papers, black-and-white negative films, as well as light-sensitive photographic color materials such as color negative films, color reversal films, color papers, etc. can benefit of the use of the present invention.

The light sensitive layers intended for use in color photographic material contain or have associated therewith dye-forming compounds or couplers. For example, a red-sensitive emulsion would generally have a cyan coupler associated therewith, a green-sensitive emulsion would generally have a magenta coupler associated therewith, and a blue-sensitive emulsion would generally have a yellow coupler associated therewith.

The silver halide photographic materials of the present invention are fore-hardened. Typical examples of organic or inorganic hardeners include chrome salts (e.g., chrome alum, chromium acetate), aldehydes (e.g., formaldehyde and glutaraldehyde), isocyanate compounds (hexamethylene diisocyanate), active halogen compounds (e.g., 2,4-dichloro-6-hydroxy-striazine), epoxy compounds (e.g., tetramethylene glycol diglycidylether), N-methylol derivatives (e.g., dimethylolurea, methyloldimethyl hydantoin), aziridines, mucohalogeno acids (e.g., mucochloric acid), active vinyl derivatives (e.g., vinylsulfonyl and hydroxy substituted vinylsulfonyl derivatives) and the like. Other references to well known hardeners can be found in *Research Disclosure,* December 1989, Vol. 308, Item 308119, Section X.

Other layers and additives, such as subbing layers, surfactants, filter dyes, intermediate layers, protective layers, anti-halation layers, barrier layers, development inhibiting compounds, speed-increasing agent, stabilizers, plasticizer, chemical sensitizer, UV absorbers and the like can be present in the photographic element.

A detailed description of photographic elements and of various layers and additives can be found in Research Disclosure 17643 December 1978, 18431 August 1979, 18716 November 1979, 22534 January 1983, and 308119 December 1989.

The silver halide photographic material of the present invention can be exposed and processed by any conventional processing technique. Any known developing agent can be used into the developer, such as, for example, dihydroxybenzenes (e.g., hydroquinone), pyrazolidones (1-phenyl-3-pyrazolidone- 4,4-dimethyl-1-phenyl-3-pyrazolid-one), and aminophenols (e.g., N-methyl-p-aminophenol), alone or in combinations thereof. Preferably the silver halide photographic materials are developed in a developer comprising dihydroxybenzenes as the main developing agent, and pyrazolidones and p-aminophenols as auxiliary developing agents.

Other well known additives can be present in the developer, such as, for example, antifoggants (e.g., benzotriazoles, indazoles, tetrazoles), silver halide solvents (e.g., thiosulfates, thiocyanates), sequestering agents (e.g., aminopolycarboxylic acids, aminopolyphosphonic acids), sulfite antioxidants, buffers, restrainers, hardeners, contrast promoting agents, surfactants, and the like. Inorganic alkaline agents, such as KOH, NaOH, and LiOH are added to the developer composition to obtain the desired pH which is usually higher than 10.

The silver halide photographic material of the present invention can be processed with a fixer of typical composition. The fixing agents include thiosulfates, thiocyanates, sulfites, ammonium salts, and the like. The fixer composition can comprise other well known additives, such as, for example, acid compounds (e.g., metabisulfates), buffers (e.g., carbonic acid, acetic acid), hardeners (e.g., aluminum salts), tone improving agents, and the like.

The present invention is particularly intended and effective for high temperature, accelerated processing with automatic processors where the photographic element is transported automatically and at constant speed from one processing unit to another by means of roller. Typical examples of said automatic processors are 3M TRIMATIC™ XP515 and KODAK RP X-OMAT™. The processing temperature ranges from 20° to 60° C., preferably from 30° to 50° C. and the processing time is lower than 90 seconds, preferably lower than 45 seconds. The good antistatic and surface characteristics of the silver halide photographic material of the present invention allow the rapid processing of the material without having the undesirable appearance of static marks or scratches on the surface of the film.

The invention will be described hereinafter by reference to the following example.

EXAMPLE 1

A tabular grain silver bromide emulsion (having an average diameter:thickness ratio of about 7.6:1, prepared in the presence of a deionized gelatin having a viscosity at 60° C. in water at 6.67% w/w of 4.6 mPas, a conducibility at 40° C. in water at 6.67% w/w of less than 150 μs/cm and less than 50 ppm of $Ca^{++}$) was optically sensitized to green light with a cyanine dye and chemically sensitized with sodium p-toluenethiosulfonate, sodium p-toluenesulfinate and benzothiazoleiodoethylate. At the end of the chemical digestion, non-deionized gelatin (having a viscosity at 60° C. in water at 6.67% w/w of 5.5 mPas, a conducibility at 40° C. in water at 6.67% w/w of 1,100 μs/cm and 4,500 ppm of $Ca^{++}$) was added to the emulsion in an amount to have 83% by weight of deionized gelatin and 17% by weight of non-deionized gelatin. The emulsion, containing 5-methyl-7-hydroxy-triazaindolizine stabilizer and a hardener, was divided into twelve portions. Each portion was coated on each side of a blue polyester film support at a silver coverage of 2.15 g/m$^2$ and a gelatin coverage of 1.5 g/m$^2$ per side. A non-deionized gelatin protective supercoat containing 1.01 g/m$^2$ of gelatin per side and the compounds indicated in Table 1 was applied on each coating so obtaining twelve different double-side radiographic films 1 to 12.

Silwet™ L-7605 is the trade name of a polyalkyleneoxide-modified dimethylpolysiloxane surfactant manufactured by Union Carbide and having the following formula:

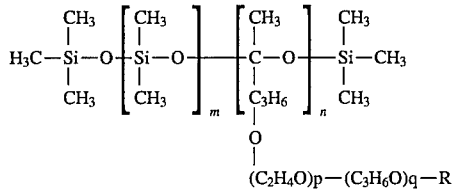

wherein m ranges from 5 to 100, n ranges from 2 to 50, p ranges from 5 to 50, and q ranges from 0 to 50.

The samples 1 to 12 were conditioned for 15 hours at 25% of relative humidity. After conditioning the samples were exposed and developed. After that they were subjected to the evaluation of the coating quality by technical people. The evaluation of coating quality and roughness of Table 2 was expressed by scholastic score as an average of the evaluation of three technical people: 4 means unacceptable, 5 means insufficient, 6 means sufficient, 7 means good, 8 means very good and 9 means optimum. The samples were then evaluated according to the following tests.

TABLE 1

| Sample | Triton ™ X-100 mg/m$^2$ | Triton ™ X-200 mg/m$^2$ | Zonyl ™ SFN mg/m$^2$ | Silwet ™ L-7605 mg/m$^2$ | Compound A mg/m$^2$ | Note |
|---|---|---|---|---|---|---|
| 1 | | | | | | control |
| 2 | 70 | | | | | control |
| 3 | 70 | 100 | | | | control |
| 4 | 70 | 100 | 40 | | | invention |
| 5 | 70 | 100 | 40 | 40 | | invention |
| 6 | | 100 | | 160 | 80 | U.S. Pat. No. 4582781 |
| 7 | | 100 | 160 | | 80 | U.S. Pat. No. 4582781 |
| 8 | | 100 | 80 | 80 | 80 | U.S. Pat. No. 4582781 |
| 9 | 70 | 50 | 40 | | | invention |
| 10 | 70 | 100 | | 40 | | invention |
| 11 | 70 | | 40 | 40 | | invention |
| 12 | | | 40 | 40 | | control |

Compound A is a lithium trifluoromethanesulphonate according to U.S. Pat. No. 4,582,781, Triton™ X-200 is the trade name of an anionic surfactant of the alkylphenyloxyethylene sulphonate type having the following formula:

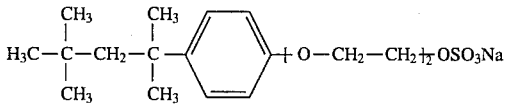

Triton™ X-100 is the trade name of a non-ionic surfactant of the alkylphenoxyethylene type having the following formula:

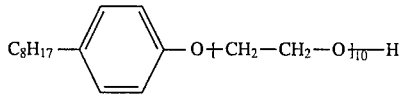

Zonyl™ SFN is the trade name of a non-ionic surfactant of the perfluoroalkylpolyoxyethylene type, manufactured by DuPont and having the following formula:

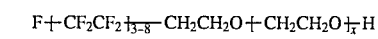

wherein x is an integer from 10 to 20.

CHARGE DECAY TIME TEST

According to this test the static charge dissipation of each of the films was measured. The films were cut into 45×54 mm samples and conditioned at 25% relative humidity and T=21° C. for 15 hours. The charge decay time was measured with a Charge Decay Test Unit JCI 155 (manufactured by John Chubb Ltd., London). This apparatus deposits a charge on the surface of the film by a high voltage corona discharge and a fieldmeter allows observation of the decay time of the surface voltage. The lower the time, the better the antistatic properties of the film. To prevent the charge decay behavior of the tested surface from being influenced by the opposite surface, this surface was grounded by contacting it with a metallic back surface.

SURFACE RESISTIVITY TEST

According to this test the resistivity of the sample surface was measured using the Hewlett Packard model 4329A high resistance meter. The lower the value, the better the antistatic protection of the film.

SLIPPERINESS TEST

This test was performed with a Lhomargy apparatus. It consists of a slide moving on the film at a speed of about 15 cm/min. A force transducer connected to the slide transforms the applied force into an amplified DC voltage which is recorded on a paper recorder. The force applied to start the sliding movement represents the value of static slipperiness. The movement of the slide on the film is not continuous. The discontinuity of the movement can be measured (in terms of slipperiness difference) from the graph of the paper recorder. This value represents the dynamic slipperiness. It was noted that the more the movement was discontinuous (i.e., the higher the value of slipperiness difference), the better was the performance of the film.

TACKINESS TEST

Each sample was cut into 24 pieces measuring 6 cm×3.5 cm. The resulting samples were conditioned at 24° C. and 90% relative humidity for at least 15 hours. With the samples six pairs of film having the emulsion layer against the emulsion layer and six having the emulsion layer against the backing layer were prepared. Each pair of samples was loaded with a weight of 1.5 Kg for 15 hours at 24° C. and 90% relative humidity. At the end the force necessary to detach every pair of samples was measured and the final result was the average of the six measurements.

The results of the above mentioned tests are summarized in the following Table 2.

The best results in terms of antistatic protection and sensitometry can be achieved using samples 4 and 5, which comprise Triton™ X-200, Triton™ X-100, Zonyl™ SFN and, optionally, Silwet™ L-7605, in optimum amount and relative proportions. Sample 9, similar to sample 4, but having a lower amount of Triton™ X-200, still shows good results. Samples 10 and 11, similar to sample 5, but lacking Zonyl™ SFN or Triton™ X-200, show good results comparable to those of sample 9.

EXAMPLE 2

Three additional silver halide radiographic materials were prepared according to the method of example 1, with the only difference being that the compounds of Table 4 were added to the top-coat.

Silwet L-77 and Silwet L-7001 are the trade names of two polyalkyleneoxide-modified dimethylpolysiloxane surfactant manufactured by Union Carbide.

Samples 13 to 15, together with samples 7, 8 and 10 of Example 1 were conditioned for five days at 50° C. and 50% relative humidity. The result are summarized in the following Table 5.

TABLE 2

| | Physical and surface properties | | | | | | |
|---|---|---|---|---|---|---|---|
| Sample | Decay Time (sec) | Surface Resistivity ($\Omega/cm^2$) | Static Slipperiness | Dynamic Slipperiness | Roughness (Score) | Tackiness (Score) | Coating Quality (Score) |
| 1 | 290 | $5*10^{13}$ | 70 | 10 | 8 | 8 | 8 |
| 2 | 150 | $1*10^{13}$ | 80 | 0 | 8 | 8 | 8 |
| 3 | 60 | $5*10^{12}$ | 80 | 0 | 6 | 8 | 6 |
| 4 | 20 | $2*10^{11}$ | 85 | 18 | 8 | 8 | 8 |
| 5 | 10 | $1*10^{11}$ | 60 | 18 | 8 | 8 | 8 |
| 6 | 70 | $5*10^{12}$ | 70 | 10 | 8 | 4 | 6 |
| 7 | 80 | $6*10^{12}$ | 85 | 16 | 8 | 4 | 6 |
| 8 | 10 | $3*10^{11}$ | 60 | 15 | 8 | 6 | 6 |
| 9 | 50 | $1*10^{12}$ | 57 | 14 | 10 | 8 | 8 |
| 10 | 60 | $4*10^{12}$ | 65 | 0 | 8 | 8 | 8 |
| 11 | 60 | $4*10^{12}$ | 60 | 13 | 10 | 8 | 8 |
| 12 | 100 | $7*10^{12}$ | 70 | 10 | 10 | 8 | 8 |

In the following Table 3 are summarized the sensitometric characteristics of samples 1 to 12.

TABLE 3

| | Sensitometry | | |
|---|---|---|---|
| Sample | D. min | Speed | Contrast |
| 1 | 0.21 | 100 | 280 |
| 2 | 0.21 | 102 | 275 |
| 3 | 0.21 | 102 | 275 |
| 4 | 0.20 | 104 | 270 |
| 5 | 0.20 | 101 | 270 |
| 6 | 0.21 | 101 | 265 |
| 7 | 0.21 | 105 | 270 |
| 8 | 0.20 | 100 | 265 |
| 9 | 0.21 | 99 | 275 |
| 10 | 0.21 | 98 | 275 |
| 11 | 0.21 | 101 | 275 |
| 12 | 0.21 | 102 | 270 |

TABLE 4

| Sample | 13 Invention | 14 Invention | 15 Control |
|---|---|---|---|
| Triton ™ X-100 | 70 | 70 | 70 |
| Triton ™ X-200 | 100 | 100 | 100 |
| Silwet ™ L-77 | 40 | — | — |
| Silwet ™ L-7001 | — | 40 | — |
| Zonyl ™ SFN | 40 | 40 | — |
| Compound A | — | — | 80 |

TABLE 5

| Sample | Decay Time (sec) | Surface Resistivity ($\Omega/cm^2$) | Note |
|---|---|---|---|
| 7 | 126 | $6.7*10^{12}$ | Control |
| 8 | 48 | $3,1*10^{12}$ | Invention |

TABLE 5-continued

| Sample | Decay Time (sec) | Surface Resistivity ($\Omega/cm^2$) | Note |
|---|---|---|---|
| 10 | 21 | $1,5*10^{12}$ | Invention |
| 13 | 85 | $8,4*10^{12}$ | Invention |
| 14 | 81 | $5,6*10^{12}$ | Invention |
| 15 | 131 | $1*10^{13}$ | Control |

The results of Table 5 clearly show the good antistatic properties of the present invention even after a test of accelerated aging.

What is claimed is:

1. A silver halide photographic material comprising a support having at least one silver halide emulsion layer coated thereon, and a hydrophilic colloid layer coated on said at least one silver halide emulsion layer, characterized in that said hydrophilic colloid layer comprises a combination of (a) a non-ionic polyoxyethylene surfactant, an anionic polyoxyethylene surfactant, and (c) at least one surfactant selected from the group consisting of non-ionic perfluoroalkylpolyoxyethylene surfactants and polyoxyethylene-modified polysiloxane surfactants characterized in that said anionic polyoxyethylene surfactant is represented by the following formula:

$$R-(A)_m-(CH_2-CH_2-O)_n-X$$

wherein

R is an aliphatic, aromatic or a mixed hydrocarbon residue and selected from the group consisting of a linear or branched alkyl moiety having from 4 to 18 carbon atoms or an aryl group substituted with one or more alkyl groups altogether having from 4 to 18 carbon atoms, A is a divalent organic residue, selected from a group consisting of a carbonyl, a sulfonyl, an amino and an alkylene group having from 1 to 3 carbon atoms, an oxygen atom or groups consisting of two or more of the above-mentioned groups, X is an anionic group selected from the class consisting of sulfonate group, carboxylate group, phosphate group and sulfate group, and m is 0 or 1 and n is an integer of from 1 to 25.

2. The silver halide photographic material according to claim 1 characterized in that said nonionic polyoxyethylene surfactant is represented by the following formula:

$$R_2-(D)q-(\underset{\underset{R_3}{|}}{CH}-CH_2-O)r-H$$

wherein $R_2$ represents an alkyl group having 1 to 30 carbon atoms, an alkenyl group having 1 to 30 carbon atoms or an aryl group having 6 to 30 ring atoms or a combination thereof, $R_3$ represents a hydrogen atom or a methyl group, D represents a group —O—, —S—, —COO—, —$NR_4$—, —CO—$NR_4$—, or —$SO_2$—$NR_4$—, wherein $R_4$ represents a hydrogen atom or an alkyl group having 1 to 12 carbon atoms, q represents 0 or 1 and r represents an integer of 2 to 50.

3. The silver halide photographic material according to claim 1 characterized in that said non-ionic perfluoroalkylpolyoxyethylene surfactant is represented by the following formula:

$$F-(CF_2CF_2)_x-CH_2-\overset{\overset{R}{|}}{CH}-O-(CH_2\overset{\overset{R'}{|}}{CHO})_y-H$$

wherein R and R' are, independently, hydrogen or a lower alkyl of from 1 to 4 carbon atoms, x is an integer from 3 to 8, and y is an integer from 6 to 15.

4. The silver halide photographic material according to claim 1 characterized in that said polyoxyethylene modified-polysiloxane surfactant is represented by the following formula:

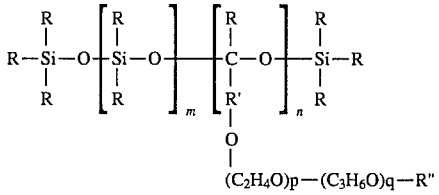

wherein R is a lower alkyl having from 1 to 4 carbon atoms, R' is a lower alkylene having from 1 to 4 carbon atoms, R" is hydrogen or a lower alkyl of from 1 to 4 carbon atoms, m is an integer from 5 to 100, n is an integer from 2 to 50, p is an integer from 5 to 50, and q is an integer from 0 to 50.

5. The silver halide photographic material according to claim 1 characterized in that each of said surfactants selected from the group consisting of non-ionic polyoxyethylene surfactants and anionic polyoxyethylene surfactants is present in an amount of from 10 to 200 $mg/m^2$.

6. The silver halide photographic material according to claim 1 characterized in that each of said surfactants selected from the group consisting of non-ionic perfluoroalkylpolyoxyethylene surfactants and polyoxyethylene-modified polysiloxane surfactants is present in an amount of from 10 to 100 $mg/m^2$.

7. The silver halide photographic material of claim 2 wherein A is selected from the group consisting of carbonylamino, sulfonylamino, aminocarbonyl, and ester.

* * * * *

UNITED STATES PATENT AND TRADEMARK OFFICE

CERTIFICATE OF CORRECTION

PATENT NO.: 5,571,665

DATED: November 5, 1996

INVENTOR(S): Ballerini et al.

It is certified that error appears in the above-identified patent and that said Letters Patent is hereby corrected as shown below:

Col. 8, line 44, "pads" should be --parts--.

Col. 8, line 45, "pads" should be --parts--.

Signed and Sealed this

Twelfth Day of August, 1997

Bruce Lehman

*Attest:*

BRUCE LEHMAN

*Attesting Officer*

*Commissioner of Patents and Trademarks*